United States Patent [19]

Anderson et al.

[11] 3,973,072

[45] Aug. 3, 1976

[54] MAGNETIC RECORDING MEDIUM HAVING BINDER-FREE PHOSPHIDE COATING

[75] Inventors: Gerald S. Anderson, Roseville; John D. Holm, Lake Elmo; Richard L. Jacobson, St. Paul; Ronald E. Smith, Robbinsdale, all of Minn.

[73] Assignee: Minnesota Mining and Manufacturing Company, St. Paul, Minn.

[22] Filed: Feb. 20, 1973

[21] Appl. No.: 333,877

[52] U.S. Cl. ..... 428/336; 428/433; 428/900

[51] Int. Cl.[2] ..... H01F 10/02

[58] Field of Search ..... 117/235–240, 117/106 R; 252/62.55; 428/336, 433, 900; 427/127–132

[56] References Cited

UNITED STATES PATENTS

| | | | |
|---|---|---|---|
| 3,188,247 | 6/1965 | De Vos et al. | 252/62.55 X |
| 3,330,631 | 7/1967 | Tsu | 117/239 X |
| 3,531,322 | 9/1970 | Kefalas et al. | 117/240 X |
| 3,549,417 | 11/1965 | Judge et al. | 117/240 X |
| 3,778,308 | 12/1973 | Roller et al. | 117/240 X |

FOREIGN PATENTS OR APPLICATIONS

| | | |
|---|---|---|
| 1,133,706 | 11/1968 | United Kingdom |

*Primary Examiner*—Bernard D. Pianatto
*Attorney, Agent, or Firm*—Alexander, Sell, Steldt and DeLaHunt

[57] ABSTRACT

Magnetic recording medium having a binder-free magnetizable coating of $M_2P$ where M consists essentially of a combination of at least two transition metals, preferably iron, nickel and/or cobalt, which medium has high coercivity and low Curie temperature, making it especially useful as an intermediate transfer medium for thermoremanent contact duplication.

9 Claims, 1 Drawing Figure

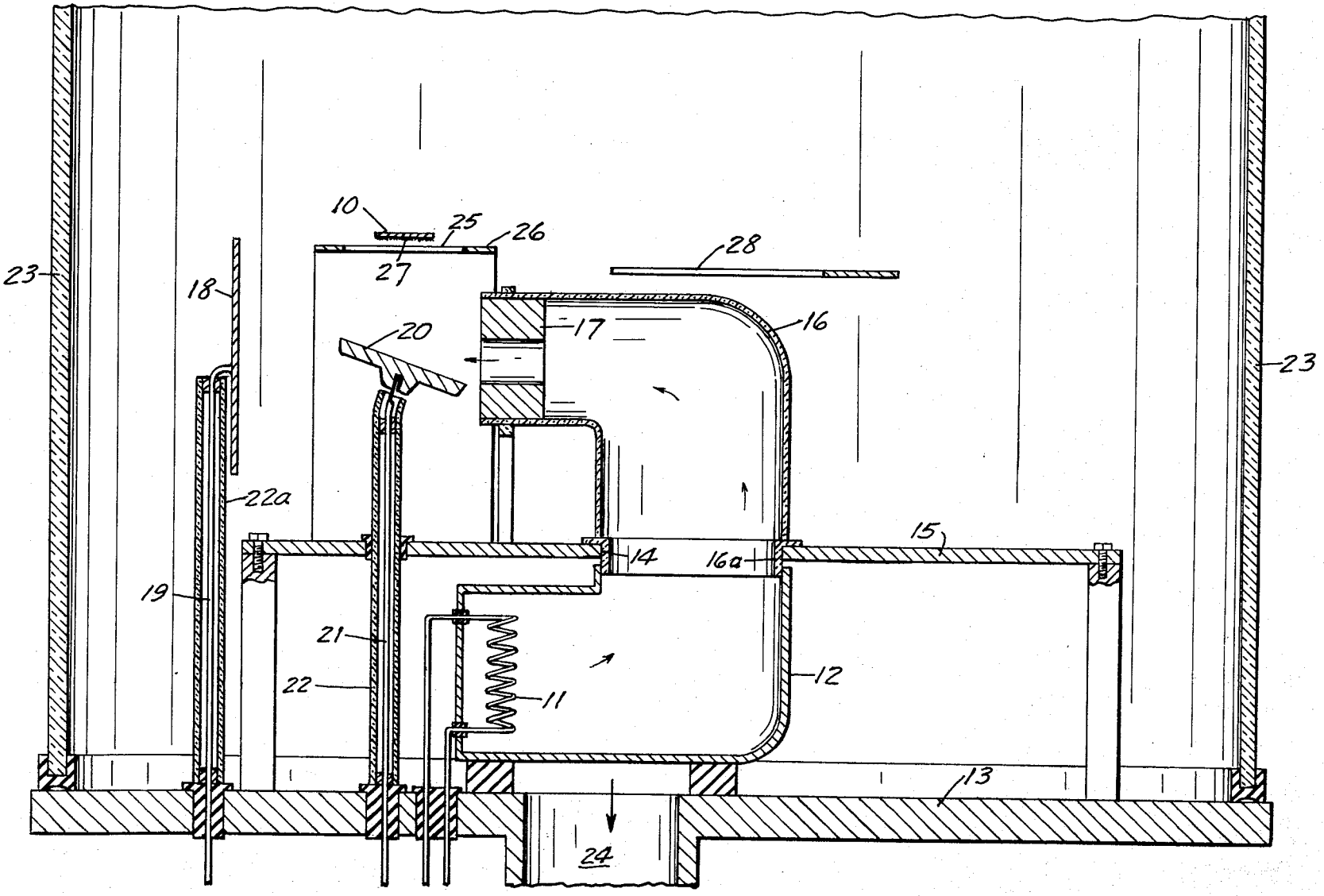
23
28
16
17
26
25
27
10
20
18
22a
19
23
15
16a
14
12
13
11
24
21
22

MAGNETIC RECORDING MEDIUM HAVING BINDER-FREE PHOSPHIDE COATING

CROSS-REFERENCE TO RELATED APPLICATION

The magnetic recording medium of the present invention is especially useful as the intermediate transfer medium of the contact duplicating apparatus of United States patent application Ser. No. 333,878, filed of even date herewith, now U.S. Pat. No. 3,827,077.

FIELD OF THE INVENTION

The present invention concerns a new magnetic recording medium which is useful as an intermediate transfer medium for thermoremanent contact duplication and may also have utility as a magneto-optic recording medium.

BACKGROUND OF THE INVENTION

U.S. Pat. No. 2,738,383 (Herr et al.) teaches that signals recorded on a master magnetic recording tape may be duplicated by placing face-to-face the magnetizable surfaces of the master tape and an unrecorded copy tape and moving them through a gradually diminishing field such as a magnetic idealizing field. By using a copy tape which has a relatively low Curie temperature and a master tape which has a higher Curie temperature, the copying can be carried out by heating the copy tape at least to its Curie temperature and then cooling it below its Curie temperature while in face-to-face contact with the master tape. U.S. Pat. No. 3,364,496 (Greiner et al.) accomplishes this using a copy tape which has a coating of ferromagnetic chromium dioxide particles having a Curie temperature of 120°C. U.S. Pat. No. 3,465,105 (Kumada et al.) also concerns thermoremanent contact duplication and employs a copy tape having a coating of spherical magnetic powder. See also U.S. Pat. No. 3,632,898 (Slade et al.) which employs a copy tape having a layer of chromium dioxide particles.

Contact duplication has not been used commercially for making copies of audio tapes, in part because electronic equipment is available for making such copies at high speeds. As for video tapes, high speed electronic copying equipment is considered to be unfeasible so that efforts are being made to commercialize contact duplication techniques such as are described in the foregoing patents. However, the copying must be of high quality to compete with the exacting requirements established by the slower electronic copying.

OTHER PRIOR ART

Magnetizable $(Fe,Co)_2P$ particles have been used in the manufacture of permanent magnets as disclosed in U.S. Pat. No. 3,188,247 (de Vos et al.)

THE PRESENT INVENTION

The present invention concerns a new magnetic recording medium onto which magnetic signals can be exactingly copied from a master tape by thermoremanent contact duplication and in turn copied onto unrecorded magnetic tape by magnetically stimulated contact duplication. By virtue of double transfer, the signals applied to the copy tape are a direct image of the signals on the master tape. Such copying can be carried out efficiently at high speeds.

Briefly, the novel magnetic recording medium comprises a backing member of low permeability and a binder-free thin film coating of approximately $M_2P$ where P is primarily phosphorous and M consists essentially of a combination of at least two transition metals providing a Curie temperature of 50°–350°C and a $B_r$ (remanent flux density) of at least 1500 gauss and an $H_c$ (coercivity) of at least 500 oersteds, both measured at 20°–25°C using a 60-Hz 3000-oersted peak applied field. In view of the trend toward recording tapes of higher $H_c$ and $B_r$, the coating of the novel medium preferably has a $B_r$ of at least 1800 gauss and an $H_c$ of at least 1500 oersteds, in which event it is especially useful as the intermediate transfer medium in the aforementioned U.S. Pat. No. 3,827,077. These preferred magnetic values are based on the assumption that the copy is made at ordinary room temperature (20°–25°C). Lower magnetic values would provide equally good results in practicing the method of said patent application by carrying out the copying at lower temperatures.

The aforementioned preferred magnetic values are readily attained by a thin film coating of approximately $M_2P$ where M is 80–90 mole percent iron, 10–20 mole percent cobalt and 0–5 mole percent nickel. Small changes within and beyond these preferred ranges have an appreciable effect upon both $H_c$ and Curie temperature, but within these ranges a preferred Curie temperature of 80° to 160°C is readily attainable. Increased Curie temperature can be attained by including small amounts of arsenic or boron with the phosphorous.

For a sputtered coating to have the preferred magnetic values mentioned above, it may be necessary to heat the coating to a temperature above 200°C either during or after the sputtering. Good results have been attained by allowing the backing member to be heated to 300°C during the sputtering, or if the temperature is lower during sputtering, by post-heating the medium to 400°–500°C in a vacuum or in an argon atmosphere. Hence, the backing member is desirably a metal.

A metal backing member should be resistant to oxidation, even when heated, and is preferably 0.025–0.125 mm in thickness. Copper alloyed with a small amount of beryllium is particularly useful and can be readily spliced into an endless belt for convenient use in apparatus illustrated in the aforementioned U.S. Pat. No. 3,827,077. Other copper-based alloys such as those containing small amounts of silver and magnesium are also useful as are aluminum, aluminum-based alloys, and "Havar" (a cobalt-based superalloy), Stainless steels may be used which do not hold appreciable magnetism.

For use in thermoremanent contact duplication, the sputtered coating may be about 0.4 to 5 micrometers in thickness. However, for use as a magneto-optic recording medium, the coating may be as thin as about 50 A.

THE DRAWING

The drawing is a schematic central section of apparatus for applying sputtered thin film coatings viewed in the direction of travel of an endless belt 10 to be sputtered. The sputtering apparatus includes a filament 11 which acts as a cathode and is positioned within a metal housing 12 that has a water-cooled jacket (not shown). An aluminum plate 15 is insulatingly mounted to a high-voltage feed-through (not shown) in the base 13 of the apparatus and has a cylindrical opening 14 above an equivalent opening in the metal housing 12. A quartz envelope 16, which rests on a Pyrex sleeve **16*a*** at the opening 14, has an annular permanent magnet 17 at its opposite end.

An anode 18 is mounted to a high-voltage feedthrough in the base 13 by a metal rod 19 which serves as an electrical lead. A target 20 is mounted on a second metal rod 21 which is fastened to another high-voltage feedthrough in the base 13 and also serves as an electrical lead to the target. A quartz tube 22 protects the rod 21 from sputtering, and a quartz tube **22*a* prevents the rod 19 from acting as an anode. Each tube 22 and 22*a* is closely spaced from the anode 18 or target 20 to isolate the anode and target from materials which may become deposited on the quartz tubes. A glass bell jar 23 is sealed to the base 13 to permit evacuation of the apparatus by a vacuum pump (not shown) through a port 24 in the base. A pulley system (not shown) drives the belt 10 past an aperture plate 26 having a rectangular aperture to permit application of a sputtered coating 27. The aperture 25 can be closed by a pivotable shutter 28.**

Further details of the sputtering apparatus as illustrated in the drawing are:

| | |
|---|---|
| Filament 11 | 1-mm tungsten wire |
| Opening 16a | 6.5 cm diameter |
| Permanent magnet 17 | Alnico V,5 cm OD, 1.8 cm ID, 2.5 cm thick |
| Anode 18 | Rectangular molybdenum plate, 0.6 mm thick, 10 cm vertically, 7.5 cm horizontally |
| Rods 19, 21 | 0.3 cm diameter nickel |
| Target 20 | 5.7 cm diameter, 1–2 cm thick, spaced 0.6 cm from the magnet 17 and inclined 20° to the horizontal |
| Quartz tubes 22a | 0.6 cm ID |
| Aperture 25 | With respect to the belt 10, 5 cm crosswise centered over the target and 10 cm lengthwise offset 0.6 cm in direction of tape travel |

Distance from magnet 17 to anode 18: 10 cm
Distance from center of target 20 to belt 10: 5.5 cm
Distance from aperture plate 26 to belt 10: 0.5 cm For the target 20 in the above-described apparatus, one may prepare an ingot. Because some phosphorous may be lost during sputtering, a preferred ingot is $M_2P_x$ where x is greater than one and up to about 1.3, preferably $M_2P_{1.1}$. Such an ingot has been made by charging the following materials to a clean graphite crucible having an inside diameter of 5.7 cm which was then covered and placed in a Vycor sleeve:

| | Moles |
|---|---|
| Iron powder (100 mesh) | 1.7 |
| Cobalt powder (230 mesh) | 0.3 |
| Red phosphorous (amorphous) | 1.3 |

The Vycor sleeve was placed on a firebrick hearth with the crucible resting on graphite supports standing on the hearth to position the crucible at the center of a 15 Kw induction heater coil. After purging the Vycor sleeve with argon for 5 minutes at 4000–5000 cc/min. flowing from the bottom to a vent hole at the top of the Vycor sleeve, the coil was energized as follows:

| Time (minutes) | Kilowatt rating |
|---|---|
| 4.5 | 80% |
| 0.5 | 50% |
| 1.0 | 40% |
| 1.0 | 20% |
| 1.0 | 10% |

A small flame became visible at 30 seconds and the crucible was red hot at one minute. By 3.5 minutes, the charge had melted. For more than 6 minutes there was a flame of burning phosphorous and attendant white $P_2O_5$ smoke at the vent. At 8 minutes the heater coil was de-energized, but the argon flow was continued for an additional 7 minutes. The cooled ingot had the formula $$(Fe_{.85}Co_{.15})_2P_{1.1}$$

EXAMPLE

The above described ingot has been used as the target 20 in the sputtering apparatus illustrated in the drawing to provide a magnetic recording medium of the present invention as follows:

A strip of beryllium copper (CDA 172 full hard) 150 cm long, 3.2 cm wide and 0.1 mm thick was formed into an endless belt by electron-beam butt welding. By polishing the splice with abrasive sheets of successively finer grit followed by polishing the whole belt with an abrasive paste, a finish of about 0.05 micrometer (root mean square) was attained. After cleaning with acetone, the belt was mounted on the pulley system of the sputtering apparatus. After blowing any dust off the belt with nitrogen gas, the bell jar 23 was positioned, and the pressure was reduced to 3 to $5 \times 10^{-6}$ torr. Then the filament was heated to its normal operating condition of 50 amps, 29 volts AC. The pumping rate was then throttled down to the desired operating point with the background pressure in the range of 5 to $8 \times 10^{-6}$ torr. Then welding grade argon gas (99.995%) was introduced into the system, increasing the pressure to about $10^{-2}$ torr. Throttling was necessary to avoid exceeding allowable pump throughputs. A positive potential of about 200 volts above the filament 11 was applied to the anode 18, producing and igniting a gaseous discharge. Thereafter the anode 18 operated at 3.4 amps and 61 volts DC.

Initially, the shutter 28 was retracted, and the belt 10 was driven at 1.8 cm/min. A negative DC potential of 175 V (with respect to the anode) was applied to the belt, resulting in an ion bombarding current of about 40 mA. This process continued for one complete pass to prepare the outer surface of the belt for a sputtered coating. During this operation, a negative DC potential of 135 V (with respect to the anode) was applied to the target 20, which resulted in an ion current of 80 mA. These conditions minimized accumulation on either the target or the belt of material sputter-removed from the other.

After the sputtering of the belt surface, the shutter 28 was pivoted to close the aperture 25, and the negative DC potential at the target 20 was increased to 1580 V (with respect to the anode) with a resulting ion current of 107 mA. This was continued for 20 minutes to clean the target and to bring the target temperature and its environs to a steady state condition. Then the negative DC potential at the belt was reduced to 3.4 V (with respect to the anode) where it was maintained. The shutter 28 was retracted and sputter deposition of the phosphide ingot target onto the belt surface proceeded for about 3 hours, or slightly more than two complete belt passes. The final phosphide coating thickness on the belt was approximately 0.6 micrometer. When the sputtering was completed, the potentials were removed, the discharge and filament were turned off and the argon gas supply was closed. The background (impurity) pressure was then in the low $10^{-6}$ torr range. The system was allowed to cool for at least one hour while continuing to drive the belt, after which the system was filled with argon gas, reaching atmospheric pressure in another 15 minutes.

The foregoing procedure was employed on a number of belts to provide phosphide coatings having a $B_r$ of 1800–2000 gauss, an $H_c$ of 1600–2000 oersteds and a Curie temperature of 110°–140°C. The first time a target is used, the Curie temperature tends to be at the lower end of that range, and in later runs, the Curie temperature tends to be at the higher end. It is believed that the beryllium and the copper of the backing may play important roles in the attainment of the high $H_c$. Even when using a beryllium copper backing, the $H_c$ may be inexplicably lower than 1600 oersteds, sometimes only about 1200 oersteds.

Certain changes in the foregoing conditions provided interesting variations in the deposited coatings. Depositing at lower target sputtering power usually resulted in a higher $B_r$ and a lower $H_c$, but the $H_c$ could be significantly increased by heat treating the belt at 400°–500°C in vacuum.

Theoretically, it should be possible to obtain sputtered coatings of greater uniformity by driving the belt 10 in the direction between the magnet 17 and the anode 18, especially where the belt is about 5 cm or more in width.

The phosphide-coated belt of the foregoing example has been used as an intermediate for copying magnetic signals from a master magnetic recording tape onto a copy tape. As described in the aforementioned patent application Ser. No. 333,878, the intermediate was moved along a predetermined path, and at a first position along the path the intermediate was heated above the Curie temperature of its magnetizable material. At a second position along the path, a master recording tape was forced into face-to-face contact with the heated intermediate while moving the intermediate in contact with a refrigerated drum until the magnetizable material of the intermediate was cooled somewhat below its Curie temperature. The master tape was promptly separated from the intermediate which remained in contact with the refrigerated drum until reaching room temperature. At a third position along the path, a copy tape was forced face-to-face against the cooled intermediate while moving the pair through a magnetic idealizing field for stimulating the magnetizable material of the copy tape to copy the signals onto the copy tape.

Although a nonmagnetic metal backing is desirable when using the novel magnetic recording medium as the intermediate in the apparatus disclosed in the aforementioned patent application Ser. No. 333,878, a polymeric backing which has good high temperature properties such as a polyimide (e.g., "Kapton") or a polysulfone (e.g., "Astral") may be employed for other applications.

Apparatus essentially as shown in the drawing, except having no aperture plate or shutter, has been used to deposit phosphide coatings onto aluminum-based disks and onto glass disks for use as the magnetic recording media of a disk pack.

We claim:

1. Magnetic recording medium comprising:
a backing member of low permeability comprising
nonmagnetic metal,
glass or
a polymer which has good high temperature properties and
a binder-free thin film coating about 50 A to 5 micrometers in thickness and of approximately $M_2P$ wherein
P is primarily phosphorus and
M consists essentially of a combination of at least two transition metals,
providing a Curie temperature of 50°–350°C, a $B_r$ of at least 1500 gauss and an $H_c$ of at least 500 oersteds.

2. Magnetic recording medium as defined in claim 1 wherein the backing member is a beryllium copper belt.

3. Magnetic recording medium as defined in claim 1 wherein M is 80–90 mole percent iron, 10–20 mole percent cobalt and 0–5 mole percent nickel.

4. Magnetic recording medium as defined in claim 1 wherein P includes a small amount of arsenic or boron.

5. Magnetic recording medium as defined in claim 1 wherein the backing member is a copper-based alloy, aluminum, an aluminum-based alloy, a cobalt-based alloy, stainless steel or glass.

6. Magnetic recording medium comprising:
a backing member of low permeability comprising
nonmagnetic metal,
glass or
a polymer which has good high temperature properties and
a binder-free thin film coating about 0.4 to 5 micrometers in thickness and of approximately $M_2P$ wherein
P is phosphorous and
M consists essentially of a combination of at least iron plus nickel and/or cobalt and comprises at least 80 mole percent iron,
providing a Curie temperature of 50°–160°C, a $B_r$ of at least 1500 gauss and an $H_c$ of at least 500 oersteds.

7. Magnetic recording medium onto which magnetic signals can be exactingly copied from a master tape by thermoremanent contact duplication in turn copied onto unrecorded magnetic tape by magnetically stimulated contact duplication, said medium comprising a metal backing member of low permeability and a binder-free thin film coating about 50 A to 5 micrometers in thickness and of approximately $M_2P$ wherein P is phosphorus and M is 80–90 mole percent iron, 10–20 mole percent cobalt and 0–5 mole percent nickel, which coating has an $H_c$ of at least 1500 oersteds, a $B_r$ of at least 1800 gauss and a Curie temperature of 80°–160°C.

8. Magnetic recording medium comprising a metal backing member of low permeability and a binder-free thin film coating about 0.4 to 5 micrometers in thickness and of approximately $(Fe_{.85}Co_{.15})_2P$ providing a Curie temperature of 50°–350°C, a $B_r$ of at least 1500 gauss and an $H_c$ of at least 500 oersteds.

9. Magnetic recording medium comprising:
a metal backing member of low permeability and
a binder-free thin film coating about 0.4 to 5 micrometers in thickness and of approximately $M_2P$ wherein
P is primarily phosphorus and
M consists essentially of a combination of at least iron plus nickel and/or cobalt
to provide a Curie temperature of 50°–350°C, a $B_r$ of at least 1500 gauss and an $H_c$ of at least 500 oersteds.

* * * * *